US006109489A

United States Patent [19]

Marlowe

[11] Patent Number: 6,109,489

[45] Date of Patent: Aug. 29, 2000

[54] BUTTON ELEVATOR AND ATTACHMENT AID

[76] Inventor: Constance J. Marlowe, 811 Threadneedle #270, Houston, Tex. 77079

[21] Appl. No.: 09/190,594

[22] Filed: Nov. 10, 1998

[51] Int. Cl.[7] ..... A47G 43/00

[52] U.S. Cl. ..... 223/1; 223/44

[58] Field of Search ..... 223/104, 44, 102, 223/109 R; 112/36, 110, 111, 112

[56] References Cited

U.S. PATENT DOCUMENTS

| | | | |
|---|---|---|---|
| D. 262,838 | 2/1982 | Rader | D3/18 |
| 640,853 | 1/1900 | Arnold | 223/102 |
| 1,731,556 | 10/1929 | Wren et al. | 223/1 |
| 1,998,418 | 4/1935 | Fridolph | 223/104 |
| 2,513,633 | 7/1950 | Folsom | 112/36 |
| 2,873,900 | 2/1959 | Jackson | 223/104 |
| 4,520,955 | 6/1985 | Gutweniger | 233/44 |
| 4,886,003 | 12/1989 | Walker | 223/104 |

*Primary Examiner*—Bibhu Mohanty
*Attorney, Agent, or Firm*—Russell J. Egan

[57] ABSTRACT

A device for properly positioning a button for attachment to a garment or the like by sewing, preferably hand sewing, has a button supporting body and an integral needle. The needle is pushed into the fabric of the garment to position the body over the point of attachment. A "sew-through" button having two or four holes is placed on the body ands sewn to the garment with the device providing both proper positioning as well as proper spacing for the garment.

2 Claims, 1 Drawing Sheet

BUTTON ELEVATOR AND ATTACHMENT AID

BACKGROUND OF THE INVENTION

1. The Field of the Invention

The present invention relates to a device for properly positioning buttons having "sew-through" holes, for attachment to garments or fabric, and particularly for hand sewing attachment of these buttons in a uniform manner.

2. The Prior Art

Sew-through buttons come in many shapes and sizes, but most have either two or four holes. The conventional method of attaching buttons to garments or fabrics by hand is with thread. In this method, the button to be attached is positioned at a desired location on the garment or fabric and a threaded needle is sequentially inserted through each hole in the button and through the garment or fabric several times until a sufficient number of strands of thread are formed to securely hold the button onto the garment or fabric. The ends of the thread are then tied or otherwise fastened so that the thread will not unravel. This is most commonly achieved by laterally wrapping the strands firmly with additional thread.

Where, as in most cases, it is necessary to elevate the button from the garment or fabric, the formation of a pedestal effect or shank is needed. The purpose of this shank is to provide a loose fit between the button and fabric. When the button passes through a button hole on a second piece of material, the shank provides sufficient clearance and freedom of movement of the button to provide easy manipulation and ample spacing of the button for fastening. A problem encountered when hand sewing buttons to fabric is providing this shank between the bottom of the button and the garment or fabric and, in particular, to provide all buttons on a garment with uniform shanks.

This problem has been solved in the past by holding the button away from the garment or fabric by hand and sewing as usual. Although this method is somewhat satisfactory in providing a space, it suffers from the following disadvantages:

a. It is clumsy to hold both pieces in place by hand; and
b. It is difficult to hold the button spaced parallel to the fabric. If the button is not held firmly in this position during sewing, the shank will be uneven. In addition, with this method it is highly unlikely there will be any consistency in the height of the buttons sewn to the same garment or fabric.

One known approach to solving this problem has been to lay a toothpick, or other similar small, flat object, across or beneath the button such that it is positioned between the sew-through button holes. After stitching of the button is completed, the toothpick is removed by sliding it out from between the button and thread, which thus provides for sufficient slack in the thread to form a shank. At this point the strands of the shank are wrapped firmly with additional thread. Although this method is somewhat satisfactory in providing a space, it suffers from the following disadvantages:

a. This method is clumsy in that both the toothpick, or other object, are loose and must he held in place, along with the button and garment or fabric, during stitching;
b. If the toothpick, or other object, is not smooth, it can catch upon threads during removal and cause an uneven shank, damaged threads, or damage to the garment or fabric; and.
c. It is time consuming to interrupt a sewing project to hunt for properly sized spacing objects which will provide uniform spacing.

U.S. Design Pat. No. 262,838 shows a button spacer of the above type. This spacer has several arms to accommodate for different shank lengths.

The problem has been addressed in the use of a button elevator formed as a portion of a conventional flat plastic sewing aid, such as a ruler. This sewing aid has keyhole shaped openings formed along one side or end edge. The button is placed on top of the sewing aid with the holes centered over the opening. While this is somewhat more satisfactory than the previously discussed methods, it suffers from the following disadvantages:

a. It is clumsy to hold the sewing aid, due to its size and shape; and
b. There is nothing to hold the sewing aid in place during sewing.

U.S. Pat. No. 4,520,955 shows a button sewing aid of the above type. However, this device is intended for use with a sewing machine where the foot of the machine will hold everything in place during sewing. Should this device be used for hand sewing, it would have all of the above discussed problems.

It would be advantageous to have a device which will properly position a button during the sewing operation, provide consistent spacing of the buttons from the garment or fabric, and will hold itself in place so as to enhance the ease of use.

SUMMARY OF THE INVENTION

A sewing aid, according to the present invention, for properly and uniformly positioning buttons for attachment to a garment is formed with a body portion and an integral pin to hold the aid in place during sewing. The body portion has a thickness substantially equal to the desired spacing of the buttons from the fabric and a profile adapted to support the button to be attached in such manner as to allow free passage of attaching thread between the fabric and the button. The integral pin projecting from one end of the body portion engages the fabric to temporarily secure the sewing aid in proper position on the fabric throughout the sewing operation.

The subject method for uniformly attaching buttons to a garment or fabric includes the steps of providing a profiled button positioning device having a thickness substantially equal to the desired spacing off the buttons from the fabric and a profile adapted to support the button to be attached in such manner as to allow free passage of attaching thread between the fabric and an integral pin projecting from one end of the body. The device is positioned on the fabric by engaging the pin in the fabric. A button is placed on the support surface of the device and sewn to the garment by sequentially passing a threaded needle through the button holes and underlying fabric. Upon completion of the sewing, the device is removed from between the fabric and button and the thus formed shank is finished in conventional fashion.

There are many objects and advantages of the present invention including the following:

Providing a new and useful sewing aid for fastening buttons to garments and fabric which will provide for uniform spacing of the buttons and positive hold of the device during attachment of the button;

To provide a button fastening sewing aid which, when used to attach buttons to a garment or fabric in a raised position, can achieve a look similar to that achieved by machines;

To provide a button fastening sewing aid which, when used to attach buttons to a garment or fabric in a raised position, can achieve consistency in the length of the shank;

To provide a button fastening sewing aid which holds the garment or fabric flat thus allowing for consistency in the length of the shank;

To provide a button fastening sewing aid which has smooth surfaces thereby avoiding thread and/or garment/fabric damage upon removal from the finished button;

To provide a button fastening sewing aid which can be easily used, even by those who are inexperienced in sewing;

To provide a button fastening sewing aid which can be readily stored in a pin box or pin cushion for ease of storing and locating;

To provide a button fastening sewing aid which can be readily mass produced; and To provide a button fastening sewing aid which can be easily and economically manufactured in various sizes to accommodate different button styles and shank lengths.

BRIEF DESCRIPTION OF THE DRAWINGS

The present invention will now be described, by way of example, with reference to the accompanying drawings, in which.

DESCRIPTION OF A PREFERRED EMBODIMENT

Figure 1:
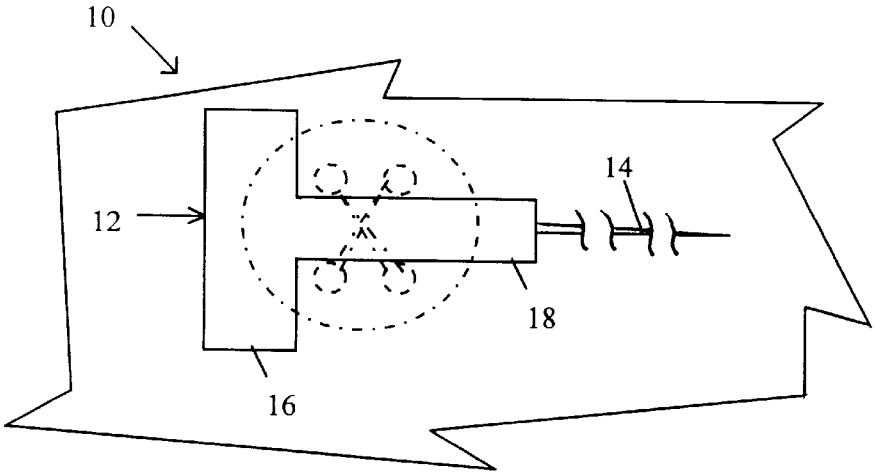
FIG. 1 is a top plan view of the button lifting device as it would be applied to a garment for properly positioning a button for attachment thereto, a button being shown in phantom;.

A typical embodiment of the button lifting device of the present invention is illustrated in FIG. 1. The subject button lifting device 10 has a body 12 with an integral pin 14. In this embodiment the body is generally T shaped with a cross bar 16 and depending leg 18. The integral pin 14 is embedded in and forms an axial extension of the leg 18. The body 12 provides for receiving and holding of buttons of different sizes with either two or four sew through holes. In the preferred embodiment, the head is shaped like a T, but other shapes, such as an E shape, would be suitable as long as the profile will allow for the removal of the button lifting device from beneath the sewn on button and it is wide enough to hold the fabric down. Both of these features contribute to the consistency in the size of the shank.

Figure 2:
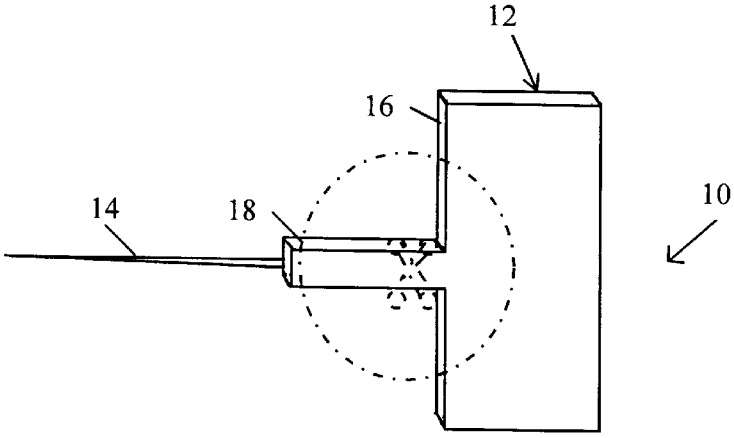
FIG. 2 is a perspective view of the subject button positioning device with a button illustrated in phantom.
Figure 3:
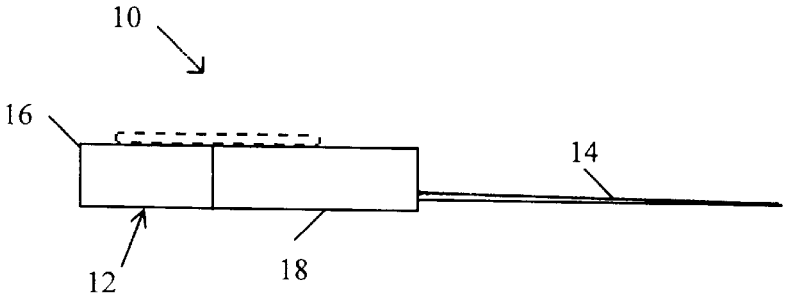
FIG. 3 is a side elevation of the subject button positioning device.

The button lifting device 10 is designed to accommodate buttons having sew-through holes as illustrated in FIG. 2. Particularly as seen in FIG. 2, the button lifting device will work with buttons having four sew-through holes. Other buttons may have just two sew-through holes, but the subject device will work with either type of button. The positioning of the button on the head is such that the sew-through holes are positioned on either side of the leg 18, as illustrated in FIG. 2. The outer edge of the button is positioned near the top of the cross bar 16, thereby supporting the button in a horizontal position, parallel to and spaced from the fabric, thus avoiding tilting of the button.

When attaching the button to a piece of fabric, the following procedure is used: The integral pin 14 of the subject button lifter is inserted down through and back up through the fabric in such a position as to allow the leg 18 of the subject device to overlie the area of the fabric to which the button will be sewn. The button 20 is placed on the device such that the holes are positioned on either side of the leg 18 and the edge of the button is near the cross bar 16 of the device. This placement will support the button in a horizontal position, parallel to the fabric, thus avoiding tilting of the button. The device will prevent the fabric from curling up around the subject button lifter, thereby avoiding the shortening of stitches and/or puckering of the fabric. While holding the button against the subject device, the button is then attached with a needle and thread beginning with a knotted stitch running up through the wrong side of the fabric and through a hole in the button. The thread is then pushed down through the hole on the opposite side of the leg 18, down through the fabric, thus encircling the leg subject device with thread. The same stitching sequence is continued an appropriate number of times such that the button will be securely held to the fabric. If the button has two sew-through holes, the button is positioned in the same way as in FIG. 2 such that the holes are positioned over the desired fastening point in the fabric. The sewing procedure is the same with two-hole buttons and four-hole buttons. When the appropriate number of stitches are made, the final stitch is made running up through only the fabric so that the needle and thread will then be located between the right side of the fabric and the button. The button lifter is then removed by grasping the cross bar 16 of the button lifter and withdrawing the device from the fabric. This provides a spacing or shank between the button and the fabric. At this point, the strands of the shank are laterally wrapped the desired number of times with additional thread. The thread is then run down through to the wrong side of the fabric where it is tied or otherwise fastened so that the thread will not unravel.

It is contemplated that the subject invention can be advantageously manufactured in a number of ways. For example, the body portion could be extruded, sliced into segments and a heated pin inserted into the leg to be permanently attached thereto. The subject device could also be stamped from light weight metal and the pin crimped to the leg. Other methods of manufacture and materials for manufacture will be apparent to those skilled in the art.

Thus it is apparent that there has been provided in accordance with the invention, a button sewing aid for hand sewing that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

The present invention may be subject to a wide variety of changes and modifications without departing from the spirit of essential characteristics of the present invention as defined by the appended claims. The foregoing description should therefor be considered in all respects as illustrative of the subject invention as defined by the appended claims.

I claim:

1. A unitary device for properly positioning buttons for attachment to a garment or fabric, said device having no moving parts and comprising:

a body member having a T-shaped profile and a thickness substantially equal to the desired spacing of the buttons from the garment or fabric, said body member supporting the button to be attached in such manner as to allow free passage of attaching thread transversely between the garment or fabric and the button; and needle means immovably fixed to and projecting from one end of the depending leg of said body member to engage in said garment or fabric to temporarily secure the device in proper position on the garment or fabric.

2. A method for properly positioning buttons for attachment to a garment or fabric by hand sewing, comprising the steps of:

providing a profiled positioning device having a thickness substantially equal to the desired spacing of the buttons from the garment or fabric and a profile adapted to support the button to be attached in such manner as to allow free passage of attaching thread between the garment or fabric and the button and needle means fixedly projecting from one end of said device;

positioning said device on the garment or fabric by engaging said needle in said garment or fabric;

placing a button on a support surface of said device;

sewing said button in place; and removing said device from said garment or fabric and from beneath said button.

* * * * *